US006666136B2

(12) United States Patent
Lee

(10) Patent No.: US 6,666,136 B2
(45) Date of Patent: Dec. 23, 2003

(54) PAPER-FEED ROLLER AND FABRICATION METHOD THEREOF

(75) Inventor: Yong-hyun Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/281,362

(22) Filed: Oct. 28, 2002

(65) Prior Publication Data

US 2003/0097945 A1 May 29, 2003

(30) Foreign Application Priority Data

Nov. 26, 2001 (KR) ..... 2001-073960

(51) Int. Cl.[7] ..... B41F 5/00; B65H 29/66; B41J 2/47; B41J 2/315

(52) U.S. Cl. ..... 101/216; 101/118; 271/216; 271/224; 347/232; 347/233; 347/332; 400/120.01; 156/89.11; 156/279; 156/283

(58) Field of Search ..... 101/216, 118; 271/314, 274; 347/332, 232, 233; 400/120.01; 156/89.11, 279, 283

(56) References Cited

U.S. PATENT DOCUMENTS 4,901,904 A * 2/1990 Tsuno ..... 228/56.3
5,107,382 A * 4/1992 Matsuzawa et al. ..... 360/103
5,352,254 A * 10/1994 Celikkaya ..... 51/295
5,429,574 A * 7/1995 Murakami ..... 492/39
5,553,845 A * 9/1996 Sawa et al. ..... 271/314
5,641,330 A * 6/1997 Celikkaya et al. ..... 51/309
5,674,020 A * 10/1997 Kimura et al. ..... 401/197
5,860,172 A * 1/1999 Pfeiffer ..... 4/619
5,876,129 A * 3/1999 Suzuki ..... 400/120.01
5,988,635 A * 11/1999 Ohshima ..... 271/274
6,056,912 A * 5/2000 Sohda et al. ..... 264/478
6,229,558 B1 * 5/2001 Saigo et al. ..... 347/232
2001/0047732 A1 * 12/2001 Kakurai ..... 101/118

* cited by examiner

*Primary Examiner*—Andrew H. Hirshfeld
*Assistant Examiner*—Marvin P Crenshaw
(74) *Attorney, Agent, or Firm*—Staas & Halsey LLP

(57) ABSTRACT

A paper-feed roller and a fabrication method thereof in an office automation machine, such as a photocopier, a printer, and a facsimile machine, etc, includes forming a plastic roller along a general stainless shaft by a molding and forming a ceramic coating layer on a surface of the plastic roller. Accordingly, the paper-feed roller is capable of providing an economical effect in a fabrication cost and preventing a slipping of paper or a paper jam that is caused by a heat distortion and an abrasion occurring on a surface of a long time operated roller.

24 Claims, 2 Drawing Sheets

PAPER-FEED ROLLER AND FABRICATION METHOD THEREOF

CROSS-REFERENCE TO RELATED APPLICATIONS

This application claims the benefit of Korean Patent Application No. 2001-73960, filed Nov. 26, 2001 in the Korean Intellectual Property Office, the disclosure of which is incorporated herein by reference.

BACKGROUND OF THE INVENTION

1. Field of the Invention

The present invention relates to a paper-feed roller, which is employed in an office automation machine, such as a photocopier, a printer, a facsimile machine, etc, to supply and discharge to-be-copied or to-be-printed paper (herein below called 'paper'), and a fabrication method thereof, and more particularly, to a paper-feed roller and a fabrication method of producing the paper-feed roller with an economical effect in a fabrication cost and preventing a slippage of paper or a paper jam that is caused by a heat distortion and an abrasion occurring on a surface of a long time operated paper-feed roller.

2. Description of the Related Art

Generally, an office automation machine, such as a photocopier, a printer, a facsimile machine, etc, has been expected to print an image on a sheet of paper at a higher speed. Accordingly, a paper feed roller employed in the office automation machine is required to supply, convey, and discharge the paper at the higher speed while performing a basic function of preventing slipping of the paper or a paper jam.

FIG. 1 shows a general paper-feed roller 10. The paper-feed roller 10 includes a shaft 1 and a plurality of smaller rollers 2. The smaller rollers 2 are disposed around the shaft 1 and spaced from each other by a predetermined distance. The shaft 1 is generally made of a metal such as aluminum and stainless. The smaller rollers 2 are made of a material, such as rubber, that has a high surface friction, thereby preventing the paper from slipping away from the smaller rollers 2. Nitrile rubber, urethane rubber, epichlorohydrin rubber, silicone rubber, ethylenepropylene rubber, acryl rubber, butyl rubber, etc, are largely used as the rubber material.

The paper-feed roller 10 made of the rubber can supply, convey and discharge the paper at the high speed using the high surface friction in an early stage of use of the paper-feed roller 10. However, a long time use or a high-speed rotation of the paper-feed roller 10 causes a friction heat to occur on a surface of the paper-feed roller 10, and thus the surface of the paper-feed roller 10 deteriorates. Accordingly, the surface friction is reduced such that the paper easily slips away from the paper-feed roller 10, and there also occurs a paper jam. Especially, in a case of a photo printer printing a full image, there may occur an image distortion due to the slipping of the paper.

Also, if the paper-feed roller 10 has a low surface roughness, a surface abrasion is easy to occur. Therefore, a space between the smaller rollers 2 becomes wider as the paper-feed roller 10 conveys the paper, for example, approximately 20,000 sheets, for a predetermined time.

In order to solve the above problems of the lowered surface friction and the surface abrasion of the paper-feed roller 10, a method has been proposed that a pipe made of stainless or carbon steel is used as the shaft, and that a ceramic coating layer is formed on a surface of the pipe. This method may overcome the shortcoming of the lowered surface friction or the surface abrasion in the conventional rubber paper-feed roller 10, but has a difficulty in installing a gear or a gear train to the paper-feed roller 10 to transmit a rotation power to the paper-feed roller 10 due to the use of the pipe as the shaft.

SUMMARY OF THE INVENTION

The present invention has been developed in order to solve the above and other problems in the related art. Accordingly, it is an object to provide a paper-feed roller and a fabrication method capable of providing an economical effect in a fabrication cost and preventing a slippage of paper or a paper jam that is caused by a heat distortion or a abrasion occurring on a surface of a long time operated roller, by forming a plastic roller along a general shaft and forming a ceramic coating layer on a surface of the plastic roller to contact the paper.

Additional objects and advantageous of the invention will be set forth in part in the description which follows and, in part, will be obvious from the description, or may be learned by practice of the invention.

In order to achieve the above and other objects, a paper-feed roller according to an embodiment of the present invention includes a shaft and at least one roller disposed along the shaft, wherein the roller is made of plastic, and a surface of the roller to contact the paper is coated with a ceramic coating layer.

In an embodiment of the present invention, the shaft is made of stainless steel, and the roller is made of any one of ABC, PC, an epoxy resin, a urethane resin, a polyamide resin, a polyvinyl chloride resin, a polyethylene resin, a polyester resin, or a phenol resin. The ceramic coating layer is made of any one or any combination of $Al_2O_3$, $SiO_2$, $ZrO_2$, SiC, TiC, TaC, $B_4C$, $Cr_2C_2$, $Si_3N_4$, BN, TiN, AlN, $TiB_2$, $ZrB_2$, $TiO_2$, and $MgF_2$. A thickness of the ceramic coating layer is equal to or below 2,000 $\mu$m. Also, the roller has corners formed at both ends thereof to prevent the ceramic coating layer from being peeled off from the surface of the roller. The ceramic coating layer has a surface friction coefficient of 1.1±10% that is obtained by a ASTM D 1894-75 method when XEROX 4200 paper is conveyed at a speed of 500 mm/min.

According to the present invention, a method of fabricating a paper-feed roller includes forming at least one plastic roller along a metallic shaft by a molding process and forming a ceramic coating layer of a thickness equal to or below 2,000 $\mu$m on a surface of the plastic roller.

The forming of the ceramic coating layer includes jetting a processing gas including a ceramic particle onto the surface of the roller from a cathode spaced-apart from the roller by 10–20 mm in conditions of a degree of vacuum ranges from $10^{-2}$ to $10^{-3}$ torr, a voltage equal to or below 0.1 $W/cm_2$, and a low pressure plasma of the processing gas being an argon gas and an oxygen gas.

The ceramic particle consists of any one or any combination of $Al_2O_3$, $SiO_2$, $ZrO_2$, SiC, TiC, TaC, $B_4C$, $Cr_2C_2$, $Si_3N_4$, BN, TiN, AlN, $TiB_2$, $ZrB_2$, $TiO_2$, and $MgF_2$.

The method of fabricating the paper-feed roller further includes grinding the surface of the roller to an extent of roughness that is equal to or below 2,000 $\mu$m to eliminate a foreign material from the surface of the plastic roller and achieve an easy adhesiveness of the ceramic coating layer to the surface of the plastic roller.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
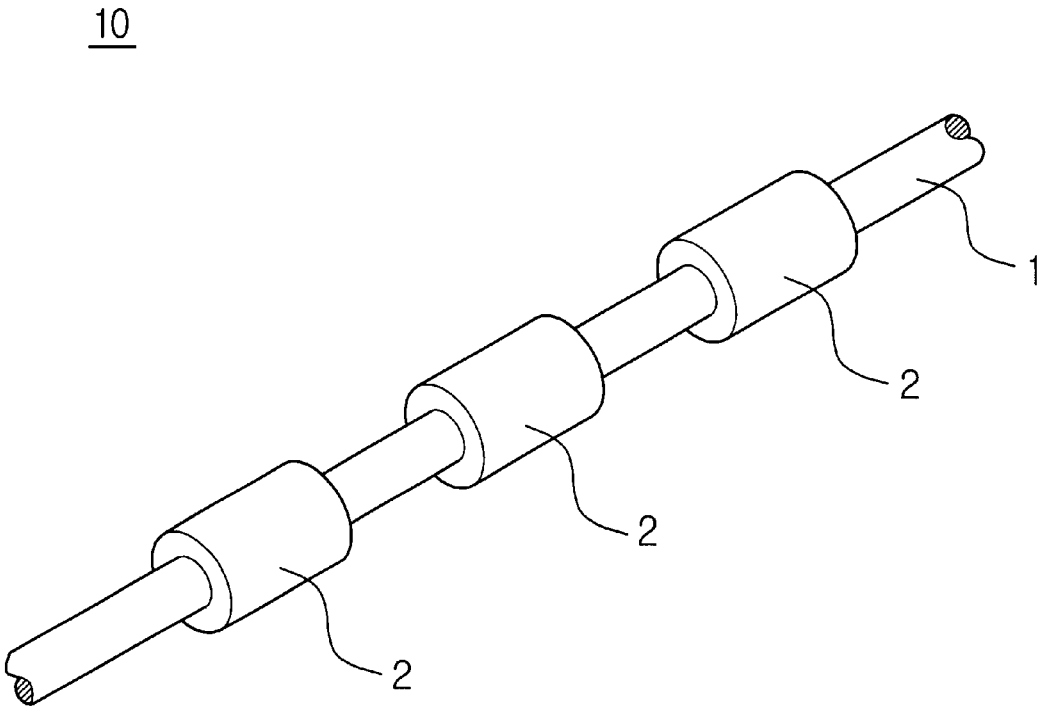
FIG. 1 is a perspective view showing a conventional paper-feed roller.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, a paper-feed roller and a fabrication method thereof in an image forming apparatus according to the present invention will be described in greater detail with reference to the accompanying drawing.

Figure 2:
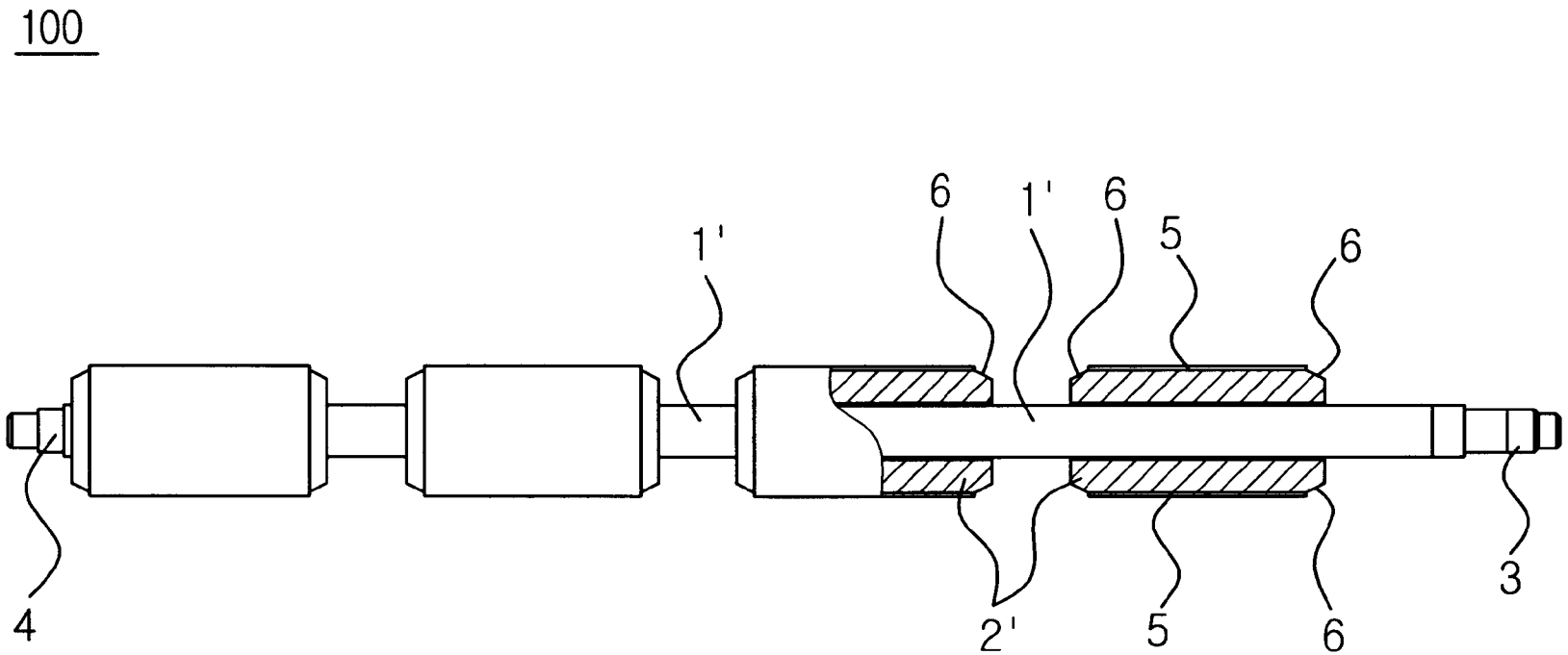
FIG. 2 is a partial section view showing a paper-feed roller in accordance with an embodiment of the present invention.

FIG. 2 shows a paper-feed roller 100 according to an embodiment of the present invention. The paper-feed roller 100 includes a shaft 1' and at least one smaller roller 2' disposed around the shaft 1'.

The shaft 1' has a stepped portion formed at one end 3 to be engaged with a gear, and another stepped portion formed at the other end 4 to be pivotably fastened to a support frame (not shown) of a printer. In this embodiment of the present invention, the shaft 1' is made of stainless steel.

The smaller rollers 2' are disposed around the shaft 1' and spaced-apart from each other by a predetermined distance. The smaller rollers 2' are made of plastic, such as ABS and PC. Otherwise, an epoxy resin, a urethane resin, a polyamide resin, a polyvinyl chloride resin, a polyethylene resin, a polyester resin, or a phenol resin is used for the smaller roller 2'. Each small roller 2' has corners 6 formed at both ends of an surface thereof to prevent a ceramic coating layer 5 from being peeled off from the surface of the smaller roller 2'.

The surface of each smaller roller 2' is coated with the ceramic coating layer 5 used to contact the paper. The ceramic coating layer 5 is formed by a wet type coating method, such as an electrolysis coating method that uses water or other water solutions. However, the wet type coating method may require a high cost for fabricating the ceramic coating layer 5 on the smaller roller 2' and may cause an environmental contamination. Alternatively, a dry type coating method, which does not use water or other water solutions, is used to form the ceramic coating layer 5 on the surface of the smaller roller 2'. There are a vacuum evaporation coating method and a sputtering method in the dry type coating method. The vacuum evaporation coating method is to evaporation-coat the surface of the smaller roller 2' with a vaporized coating material. The ceramic coating layer 5 is made of any one or any combination of $Al_2O_3$, $SiO_2$, $ZrO_2$, SiC, TiC, TaC, $B_4C$, $Cr_2C_2$, $Si_3N_4$, BN, TiN, AIN, $TiB_2$, $ZrB_2$, $TiO_2$, and $MgF_2$. The corners 6 of the smaller roller 2' are not shown as being coated with the ceramic coating layer 5. However, the corners 6 of the smaller roller 2' may be coated as necessary.

It is possible that a thickness of the ceramic coating layer 5 is equal to or less than 2,000 $\mu$m since the overly thick ceramic coating layer 5 is easy to have a crack in the surface thereof or to be peeled off from the surface of the smaller rollers 2'.

Also, a surface friction coefficient of the ceramic coating layer 5 is 1.1±10% that is obtained by a ASTM D 1894-75 method when XEROX 4200 paper is conveyed at a speed of 500 mm/min. The surface friction coefficient is increased or decreased by adjusting a volume of a ceramic particle included in a processing gas that is used during the vacuum evaporation coating or sputtering process.

A fabrication method of the paper-feed roller according to another embodiment of the present invention will be described.

The shaft 1' made of the stainless steel is prepared, and the stepped portions are formed at both ends 3 and 4 of the shaft 1' by a mechanical process. One of the stepped portions is to be engaged with the gear, and the other one of the stepped portions is to be pivotably fastened to the support frame (not shown) of the printer to support the shaft 1' with respect to the support frame.

After that, as shown in FIG. 2, the smaller rollers 2' are made of plastic, such as the ABS and PC, and are directly formed on an outer surface of the shaft 1' by an injection molding process or a molding process. The smaller rollers 2' are spaced from each other by the predetermined distance.

After the smaller rollers 2' are formed along the shaft 1', a residual stress or a foreign material, such as $H_2O$, $CO_2$, and $SO_2$, are eliminated from the surface of the smaller rollers 2'. Next, the smaller rollers 2' are ground to have a surface roughness of an average equal to or less than 2,000 $\mu$m. Due to the surface roughness of the smaller rollers 2', the ceramic coating layer 5 is easily evaporation-coated on the smaller roller 2'. The average surface roughness of the smaller rollers 2' is approximately 2,000 $\mu$m in order not to ruin an appearance of the smaller rollers 2' even with the ceramic coating layer 5 evaporation-coated thereon.

After the smaller rollers 2' are ground, the vacuum evaporation coating or sputtering process is performed on the shaft 1 in a processing chamber.

In the processing chamber, the surface of the smaller rollers 2' is coated with the ceramic coating layer 5 in a manner that the processing gas including the ceramic particle is jetted onto the smaller rollers 2' from a cathode being distanced from the smaller rollers 2' by 10–20 mm under conditions that a degree of vacuum ranges from $10^{-2}$ to $10^{-3}$ torr, a voltage is equal to or less than 0.1 $W/cm_2$ to prevent a heat distortion or a damage on the smaller rollers 2', and a low pressure plasma of the processing gas consists of an argon gas or an oxygen gas.

At this point, the ceramic particle included in the processing gas uses any one or any combination of $Al_2O_3$, $SiO_2$, $ZrO_2$, SiC, TiC, TaC, $B_4C$, $Cr_2C_2$, $Si_3N_4$, BN, TiN, AIN, $TiB_2$, $ZrB_2$, $TiO_2$, and $MgF_2$ for a dimorphic characteristic and a physical and chemical endurance of the ceramic coating layer 5. The thickness of the ceramic coating layer 5 is adjusted to be equal to or less than 2,000 $\mu$m.

Then, the surface of the smaller rollers 2' being coated with the ceramic coating layer 5 is sealed. That is, the ceramic coating layer 5 is coated with an organic substance, such as epoxy and wax, such that the epoxy and wax fills up an air cell in the ceramic coating layer 5. The sealing of the ceramic coating layer 5 is to prevent a brittle failure of the ceramic coating layer 5 in the following process.

After completing the sealing, a plate surface grinding process is finally performed in order to increase a degree of flatness of the ceramic coating layer 5.

The present invention will now be described in detail with reference to the following Example. However, it is understood that the invention is not limited thereto.

EXAMPLE

The shaft 1 was made of the stainless steel, and the smaller rollers 2' were made of general plastic, such as the ABS and PC. A combination of $Al_2O_3$ and $SiO_2$ was used as a ceramic coating material of the ceramic coating layer 5. The surface of the smaller rollers 2' was distanced from the cathode by 10–20 mm in the processing chamber under the conditions that the degree of vacuum ranged from $10^{-2}$ to $10^{-3}$ torr, the voltage was equal to or less than 0.1 $W/cm_2$, and a low pressure plasma of the processing gas was the argon gas and the oxygen gas.

The surface friction coefficient of the ceramic coating layer 5 was 1.1±10% that was obtained by the ASTM D 1894-75 method when the XEROX 4200 paper was conveyed at the speed of 500 mm/min. The surface friction coefficient was kept constant when 100,000 sheets of the paper were used and conveyed through the smaller rollers 2' of the shaft 1'.

As described above, the paper-feed roller and the fabrication method thereof according to the present invention is capable of providing an economical effect in a fabrication cost and preventing a slipping of paper or a paper jam that is caused by a heat distortion and an abrasion occurring on a surface of a long time operated roller, by forming the smaller rollers along the general shaft and by coating the surface of the smaller rollers to contact with the paper.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A paper-feed roller for use in an image forming apparatus forming an image on paper, comprising:

a shaft;

a roller disposed along the shaft and made of a plastic; and a ceramic coating layer formed on a surface of the roller to contact the paper;

wherein the ceramic coating layer comprises, ceramic particles jetted onto the roller and directly formed on the roller without using an intervening material between the roller and the ceramic particles to attach the ceramic particles to the roller.

2. The paper-feed roller of claim 1, wherein the shaft comprises stainless steel, and the roller comprises any one of ABC, PC, an epoxy resin, a urethane resin, a polyamide resin, a polyvinyl chloride resin, a polyester resin, a polyethylene resin and a phenol resin.

3. The paper-feed roller of claim 2, wherein the ceramic coating layer comprises any one of $Al_2O_3$, $SiO_2$, $ZrO_2$, SiC, TiC, TaC, $B_4C$, $Cr_2C_2$, $Si_3N_4$, BN, TiN, AlN, $TiB_2$, $ZrB_2$, $TiO_2$, $MgF_2$ and a combination thereof.

4. The paper-feed roller of claim 3, wherein a thickness of the ceramic coating layer is equal to or less than 2,000 $\mu$m.

5. The paper-feed roller of claim 3, wherein the roller comprises corners formed at both ends thereof to prevent the ceramic coating layer from peeling off from the surface of the roller.

6. The paper-feed roller of claim 5, wherein the ceramic coating layer has a surface friction coefficient of 1.1±10% that is obtained by an ASTM D 1894-75 method when a XEROX 4200 paper is conveyed at a speed of 500 mm/min.

7. A method of fabricating a paper-feed roller for use in an image forming apparatus, the method comprising:

forming a metallic shaft;

forming a plastic roller along the metallic shaft by a molding process; and forming a ceramic coating layer of a thickness equal to or below 2,000 $\mu$m on a surface of the plastic roller, wherein the forming of the ceramic coating layer comprises jetting a processing gas including ceramic particles onto the surface of the plastic roller from a cathode being distanced from the plastic roller by 10–20 mm in conditions including that a degree of vacuum ranges from $10^{-2}$ to $10^{-3}$ torr, a voltage is equal to, or below 0.1 W/cm2, and a low pressure plasma of the processing gas is an argon gas and an oxygen gas.

8. The method of claim 7, wherein the ceramic particles comprises any one of $Al_2O_3$, $SiO_2$, $ZrO_2$, SiC, TiC, TaC, $B_4C$, $Cr_2C_2$, $Si_3N_4$, BN, TiN, AlN, $TiB_2$, $ZrB_2$, $TiO_2$, $MgF_2$ and any combination of thereof.

9. The method of claim 7, further comprising grinding the surface of the plastic roller to be coated with the ceramic coating layer to an extent of roughness that is equal to or below 2,000 $\mu$m to eliminate a foreign material from the surface of the plastic roller and to achieve an easy adhesiveness of the ceramic coating layer to the surface of the plastic roller.

10. The method of claim 7, further comprising grinding the surface of the plastic roller to be coated with the ceramic coating layer to an extent of roughness that is equal to or below 2,000 $\mu$m to eliminate a foreign material from the surface of the plastic roller and to achieve an easy adhesiveness of the ceramic coating layer to the surface of the plastic roller.

11. A method of fabricating a paper-feed roller for use in an image forming apparatus, the method comprising:

forming a metallic shaft;

forming a plastic roller along the metallic shaft by a molding process;

forming a ceramic coating layer of a thickness equal to or below 2,000 $\mu$m on a surface of the plastic roller; and forming a sealed layer made of one of epoxy and wax on the ceramic coating layer.

12. The method of claim 11, wherein the forming of the sealed layer further comprises:

forming the sealed layer on a second surface of the plastic roller, which is not covered by the ceramic layer.

13. A paper-feed roller of an image forming apparatus forming an image on paper, comprising:

a shaft;

a roller disposed along the shaft, made of a plastic or rubber material, and having a cylindrical surface, sidewalls, and rounded corners formed between the cylindrical surface and respective ones of the sidewalls; a ceramic coating layer formed on the cylindrical surface of the roller to contact the paper; and a sealed layer on the ceramic coating layer and the rounded corners.

14. The paper-feed roller of claim 13, wherein the ceramic coating layer is formed between the rounded corners of the roller.

15. The paper-feed roller of claim 13, wherein the ceramic coating layer is not formed on the rounded corners.

16. The paper-feed roller of claim 13, wherein the ceramic coating layer is extended from the cylindrical surface to the rounded corners to cover the rounded corners.

17. The paper-feed roller of claim 13, wherein the cylindrical surface of the roller has a surface roughness equal to or less than 2,000 $\mu$m.

18. The paper-feed roller of claim 17, wherein the ceramic coating layer is formed on the cylindrical surface having the surface roughness equal to or less than 2,000 $\mu$m.

19. The paper-feed roller of claim 18, wherein the ceramic coating layer has a surface roughness equal to or less than 2,000 $\mu$m.

20. The paper-feed roller of claim 13, wherein a thickness of the sealed layer is equal to or less than a thickness of the ceramic coating layer.

21. The paper-feed roller of claim 13, wherein the sealed layer is an organic substance having one of epoxy and wax to fill an air cell formed in the ceramic coating layer.

22. The paper-feed roller of claim 13, wherein the shaft comprises:

a circular cylindrical bar; and a stepped portion formed on one end of the circular cylindrical bar in an axial direction.

23. The paper-feed roller of claim 22, wherein the image forming apparatus comprises a rotating gear, and the stepped portion is to be coupled to the rotating gear to transmit a rotation power to the shaft.

24. The paper-feed roller of claim 22, wherein the image forming apparatus comprises a frame, and the shaft comprises another stepper portion to be pivotably attached to the frame to support the shaft on the frame.

* * * * *

UNITED STATES PATENT AND TRADEMARK OFFICE

CERTIFICATE OF CORRECTION

PATENT NO. : 6,666,136 B2
DATED : December 23, 2003
INVENTOR(S) : Yong-hyun Lee

It is certified that error appears in the above-identified patent and that said Letters Patent is hereby corrected as shown below:

Column 6,
Line 15, change "W/cm2" to -- $W/cm^2$ --
Line 57, after "paper;" insert hard return.

Signed and Sealed this

Eighth Day of June, 2004

JON W. DUDAS
*Acting Director of the United States Patent and Trademark Office*